US005923229A

United States Patent [19]

Simons

[11] Patent Number: 5,923,229

[45] Date of Patent: Jul. 13, 1999

[54] SIMULTANEOUS POLARIZATION AND FREQUENCY FILTERING OF TRANSMITTER AND RECEIVER SIGNALS IN SINGLE ANTENNA SYSTEMS

[75] Inventor: Brent S. Simons, Santa Clara, Calif.

[73] Assignee: Wytec, Inc., Santa Clara, Calif.

[21] Appl. No.: 08/928,340

[22] Filed: Sep. 12, 1997

[51] Int. Cl.[6] ..... H01P 1/213

[52] U.S. Cl. ..... 333/135; 333/209

[58] Field of Search ..... 333/126, 135, 333/21 R, 21 A

[56] References Cited

U.S. PATENT DOCUMENTS

| | | | |
|---|---|---|---|
| 3,731,236 | 5/1973 | DiTullio et al. | 333/126 |
| 4,162,463 | 7/1979 | DiTullio et al. | 333/117 |
| 4,176,330 | 11/1979 | DiTullio et al. | 333/122 |
| 4,491,810 | 1/1985 | Saad | 333/126 |
| 4,622,524 | 11/1986 | Morz | 333/126 |
| 4,783,639 | 11/1988 | Hudspeth et al. | 333/126 |
| 4,920,351 | 4/1990 | Bartlett et al. | 333/126 X |
| 5,023,866 | 6/1991 | De Muro | 370/24 |
| 5,276,456 | 1/1994 | Kim | 333/135 X |
| 5,471,177 | 11/1995 | Hudspeth et al. | 333/126 |
| 5,576,670 | 11/1996 | Suzuki et al. | 333/126 |
| 5,659,886 | 8/1997 | Taira et al. | 455/81 |

*Primary Examiner*—Paul Gensler
*Attorney, Agent, or Firm*—Burns, Doane, Swecker & Mathis LLP

[57] ABSTRACT

An integrated OMT/filter assembly is small, low cost and not easily susceptible to mechanical or environmental damage. The integrated OMT/filter assembly has a body formed at least in part of conductive material, the body including a first port for receiving a transmit signal, a second port for feeding the transmit signal to an antenna and for receiving a receive signal, and a third port for receiving the receive signal. A first waveguide segment joins the first and second ports, and a second waveguide segment joins second and third ports, the first and second waveguide segments having a portion in common. A filter element is disposed within at least one of the first and second waveguide segments.

9 Claims, 2 Drawing Sheets

SIMULTANEOUS POLARIZATION AND FREQUENCY FILTERING OF TRANSMITTER AND RECEIVER SIGNALS IN SINGLE ANTENNA SYSTEMS

BACKGROUND OF THE INVENTION

1. Field of the Invention

The present invention relates to RF communications and more particularly to diplexers and waveguide filters.

2. State of the Art

In a bidirectional RF communications system having a radio transceiver, rather than having separate transmit and receive antennas, a single transmit/receive antenna may be used. In such a system, a mechanism is required to separate transmit energy transmitted by the antenna from receive energy received by the antenna. A diplexer is a three-port RF device used for this purpose. A first port of the diplexer is coupled to a transmit signal source. A second port of the diplexer is coupled to the transmit/receive antenna, and a third port of the diplexer is coupled to a radio receiver.

Isolation between the receive and transmit ports is acheived by filters in each port. Another mechanism which can separate signal polarization is known as an orthogonal mode transducer (OMT). In a communications system the transmit signal may have a vertical or horizontal polarization, whereas the receive signal may have the opposite polarization. An OMT takes advantage of the different polarization characteristics of the transmit and receive signals such that the transmit signal may be injected into the antenna at the same time the receive signal is being extracted from the antenna without the transmit signal and the receive signal unduly interfering with each other.

Although an OMT by itself is able to achieve signal separation to a significant degree, signal separation may be improved using filters. If the transmit signal is set to a first frequency band and the receive signal is set to a second frequency band, a first bandpass filter may be used at the transmit port to ensure that transmissions are confined within the appropriate frequency band, and a second bandpass filter may be used at the receive port to reject energy not within the appropriate frequency band, including stray energy from the transmit port.

In the prior art, the foregoing arrangement has been realized using three separate assemblies, an OMT assembly, a first waveguide filter assembly, and a second waveguide filter assembly. One common type of waveguide filter assembly is a "post and screw" waveguide filter assembly. In a post and screw waveguide filter assembly, a waveguide body is provided having a channel and flanges at either end of the channel for connecting the waveguide filter assembly to other equipment. Screws are provided at locations determined during design of the filter so as to protrude into the channel an adjustable distance. The filter may be tuned by adjusting this distance for each of the screws. Once the filter has been tuned, the waveguide body and the screws may be encapsulated, thereby fixing the characteristics of the filter.

Using the foregoing components, an RF feed section of a radio transceiver is formed by connecting an OMT to two waveguide filter assemblies and connecting the waveguide filter assemblies in turn to a radio transceiver. This construction is bulky, expensive, and subject to mechanical and environmental damage or failure.

SUMMARY OF THE INVENTION

The present invention, generally speaking, provides an integrated diplexer/filter assembly that is small, low cost and not easily susceptible to mechanical or environmental damage. In accordance with one embodiment of the invention, the integrated diplexer/filter assembly has a body formed at least in part of conductive material, the body including a first port for receiving a transmit signal, a second port for feeding the transmit signal to an antenna and for receiving a receive signal, and a third port for receiving the receive signal. A first waveguide segment joins the first and second ports, and a second waveguide segment joins second and third ports, the first and second waveguide segments having a portion in common. A filter element is disposed within at least one of the first and second waveguide segments.

BRIEF DESCRIPTION OF THE DRAWING

The present invention may be further understood from the following description in conjunction with the appended drawing.

In the drawing.

DETAILED DESCRIPTION OF THE PREFERRED EMBODIMENTS

Figure 1:
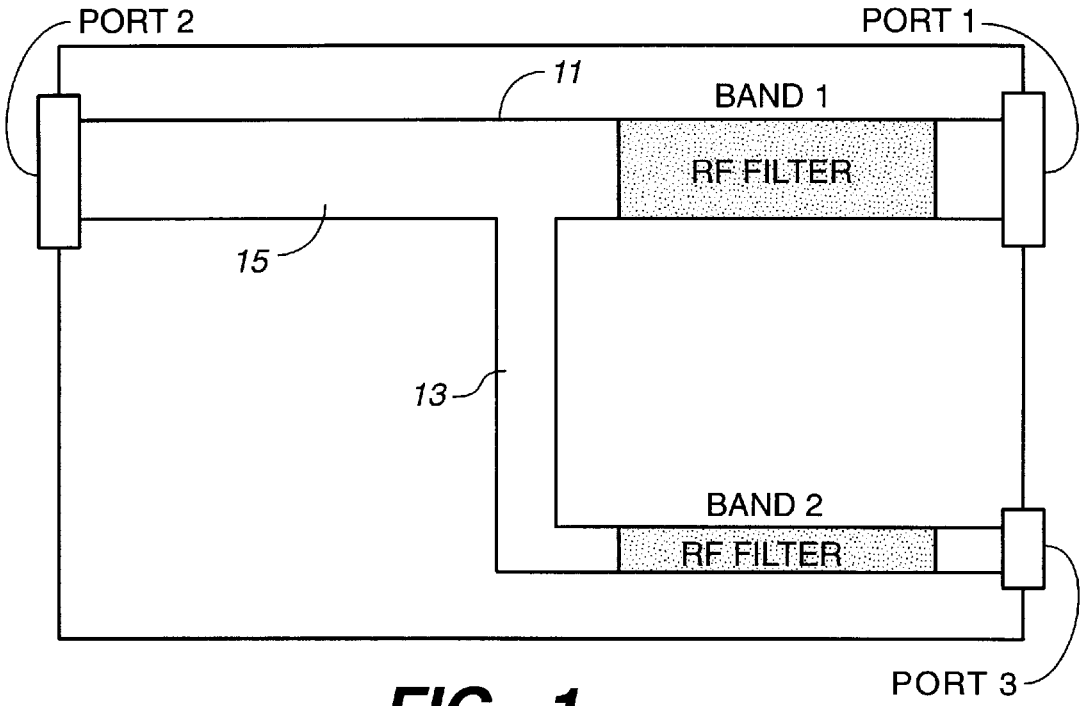
FIG. 1 is a block diagram of the present integrated diplexer/filter assembly.

Referring to FIG. 1, a block diagram of an integrated OMT/filter assembly is shown.

The particular assembly illustrated is therefore an integrated OMT/filter assembly. The integrated OMT/filter assembly of FIG. 1 is a three port device. Port 1 receives a transmit signal from a signal source. The transmit signal is assumed to occupy a frequency band 1 and to have a linear polarization A. Port 3 is coupled to a signal receiver. The receive signal is assumed to occupy a frequency band 2 and have a linear polarization B. Port 2 couples signals to and from an antenna feed. The energy at Port 2 therefore occupies frequency bands 1 and 2 and has linear polarizations A and B. Ports 1 and 2 are joined by a first waveguide segment 11. Ports 2 and 3 are joined by a second waveguide segment 13. The first and second waveguide segments have a common portion 15. Within the common portion 15 of the first waveguide segment, the waveguide undergoes a square waveguide to rectangular waveguide transition. Due to the nature of the way energy is coupled with the orthogonal waveguide ports, only energy of a specific polarization is allowed to couple into each waveguide port.

RF filter sections are disposed adjacent one or both of Ports 1 and 3. In FIG. 1, a bandpass filter that passes frequency band 1 is disposed adjacent Port 1, and a bandpass filter that passes frequency band 2 is disposed adjacent Port 3. The RF filter sections achieve increased signal separation as previously described. By including the RF filter sections within an OMT to form an OMT/filter assembly, a significant cost advantage is achieved. Furthermore, the resulting assembly is much more rugged than the corresponding assembly made from discrete parts.

In operation, Port 1 accepts a signal having a specific linear polarization (e.g., vertical polarization) and passes this signal through a frequency selective filter imbedded in the waveguide segment. Therefore, the waveguide junction in the device receives RF signal energy from Port 1 having a specific linear polarization and contained in a specific signal spectrum. This RF energy from Port 1 can exit the waveguide device through Port 2, but the energy is blocked from exiting through Port 3 by polarization and frequency conditions in that waveguide segment.

Port 2 transfers the transmitted signal from the waveguide device to the antenna feed, and it also transfers the received signal from the antenna feed into the waveguide device. The polarization and frequency of the received signal from the antenna feed differs from the transmitted signal. Thus, RF energy from Port 2 can exit the waveguide device through the frequency selective filter at Port 3, but the energy is blocked from exiting through Port 1 by polarization and frequency conditions in that waveguide segment.

Port 3 accepts the incoming signal from the antenna feed having a specific linear polarization (e.g., horizontal polarization) after this signal has passed through a frequency selective filter imbedded in the waveguide segment.

Figure 2:
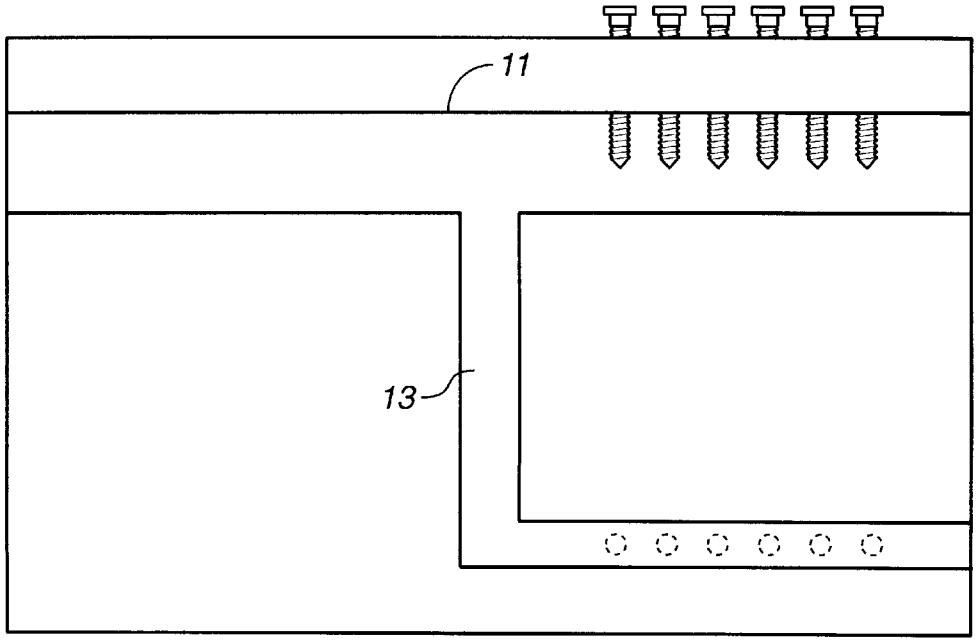
FIG. 2 is a sectional view of a first embodiment of the integrated diplexer/filter assembly of FIG. 1.

Any of various techniques may be used to form the RF filter sections of FIG. 1. Referring to FIG. 2, a cross sectional view of an OMT/filter assembly in accordance with one embodiment of the invention is shown. The RF filter sections are formed by providing screws at locations determined by the design of the filter sections. The filter sections may be tuned by adjusting the screws. The screws shown in FIG. 2 are intended to be merely representative of the actual screws, the size and location of which may be determined in detail using commercially available filter design software. The screws in the waveguide segment 13 are orthogonal to those in waveguide segment 11, and are therefore indicated as dashed-line circles.

Figure 3:
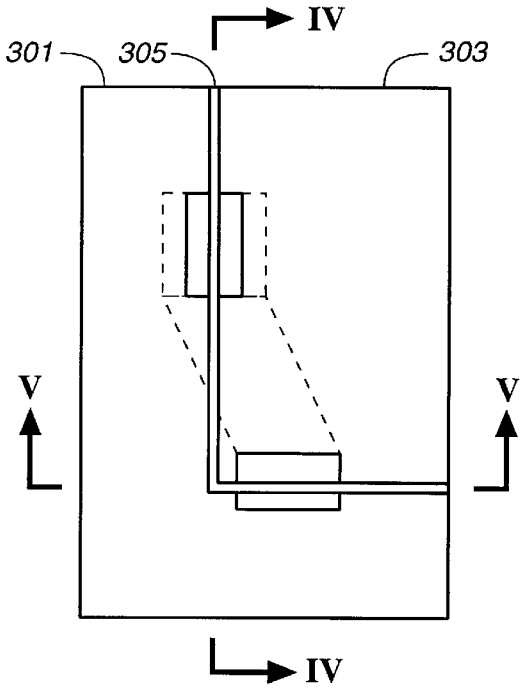
FIG. 3 is an end view of a second embodiment of the integrated diplexer/filter assembly of FIG. 1.

In an alternative embodiment, shown in exploded view in FIG. 3, the RF filter sections are formed as septum waveguide filters. In a septum waveguide filter, a septum dividing the waveguide is perforated, the size and location of the perforations being determined in accordance with the design of the filter. As shown in FIG. 3, two septum waveguide filter sections may be formed by sandwiching a septum member between the two halves of an OMT assembly, resulting in an OMT/filter assembly. The perforations shown in FIGS. 4 and 5 are intended to be merely representative of the actual perforations, the size and location of which may be determined in detail using commercially available filter design software.

Referring more particularly to FIG. 3, the OMT/filter assembly shown is formed of an L-shaped member 301, a rectangular member 303, and a thin intervening member 305. A line separating the member 301 and the member 303 divides each of the waveguide segments in half in a lengthwise direction.

Figure 4:
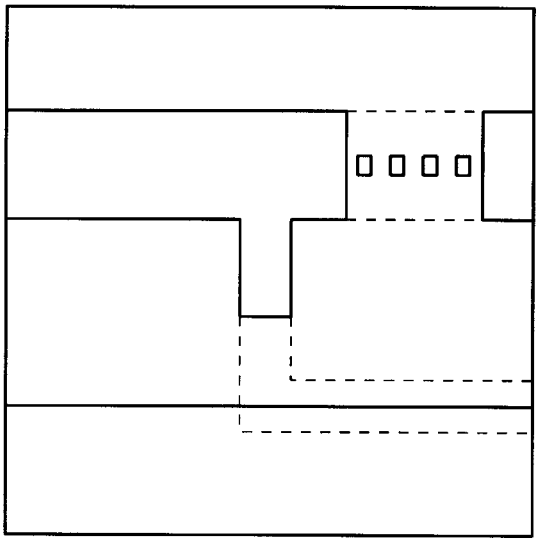
FIG. 4 is a sectional view taken along the line IV—IV in FIG. 3.
Figure 5:
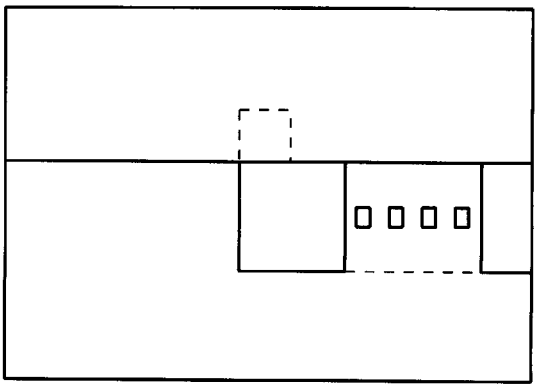
FIG. 5 is a sectional view taken along the line V—V in FIG. 3.

As seen in FIGS. 4 and 5, the intervening member 305 is cut away within the waveguide segments except for in the areas where the filter sections are to be formed. In these areas, the intervening member forms a septum having perforations as previously described.

Alternatively, the filter sections may be formed as thin-walled channel inserts having a perforated septum. The channel inserts may be inserted into the respective waveguide segments before or after connecting together opposing members of the assembly.

Although two exemplary realizations of an OMT/filter assembly have been described, the invention is not limited to these particular realizations. Rather, the RF filter sections of the OMT/filter assembly may be formed by any convenient technique in which physical features disposed within a waveguide channel are used to produce a desired filtering effect.

It will be appreciated by those of ordinary skill in the art that the present invention may be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning or range of equivalents thereof are intended to be embraced therein.

What is claimed is:

1. An integrated OMT/filter assembly having a body formed at least in part of conductive material and comprising:

a first port for receiving a transmit signal;

a second port for feeding said transmit signal to an antenna and for receiving a receive signal;

a third port, substantially coplanar with said first port, for receiving said receive signal;

a first waveguide segment joining the first and second ports;

a second waveguide segment joining the second and third ports, said first waveguide segment and said second waveguide segment having a portion in common; and filter means disposed within at least one of said first waveguide segment and said second waveguide segment;

wherein wave propagation occurs substantially within two orthogonal directions only.

2. The apparatus of claim 1, comprising first filter means disposed within said first waveguide segment and second filter means disposed within said second waveguide segment.

3. The apparatus of claim 2, wherein said first filter means is disposed between said first port and said portion in common.

4. The apparatus of claim 2, wherein said second filter means is disposed between said third port and said portion in common.

5. The apparatus of claim 1, wherein said first port and said third port are located on a single plane or face of said body.

6. The apparatus of claim 1, wherein the integrated diplexer/filter assembly functions as an orthogonal mode transducer.

7. The apparatus of claim 6, wherein said first waveguide segment includes a transition from a first cross sectional shape to a second cross sectional shape.

8. The apparatus of claim 7, wherein said first shape is square and said second shape is rectangular.

9. The apparatus of claim 8, wherein said transition occurs between said second port and said portion in common.

* * * * *